United States Patent [19]

Schneider

[11] Patent Number: 4,942,981

[45] Date of Patent: Jul. 24, 1990

[54] TUBE FOR THE DISTRIBUTION OF A PASTE WITH STRIPES COMPRISING A ONE-PIECE HEAD WITH A DOUBLE SKIRT

[75] Inventor: Bernard Schneider, Sainte Menehould, France

[73] Assignee: Cebal, Clichy, France

[21] Appl. No.: 263,907

[22] Filed: Oct. 28, 1988

[30] Foreign Application Priority Data

Nov. 3, 1987 [FR] France ..... 87 16037

[51] Int. Cl.[5] ..... B65D 35/00

[52] U.S. Cl. ..... 222/94; 222/107; 222/145; 222/564

[58] Field of Search ..... 222/94, 145, 107, 564, 222/566, 572

[56] References Cited

U.S. PATENT DOCUMENTS

| | | | |
|---|---|---|---|
| 4,132,331 | 1/1979 | Magerle | 222/107 |
| 4,568,001 | 2/1986 | Sander | 222/107 |
| 4,664,284 | 5/1987 | Magerle | 222/107 X |

FOREIGN PATENT DOCUMENTS

| | | | |
|---|---|---|---|
| 654838 | 12/1962 | Canada | 222/94 |
| 0182725 | 5/1986 | European Pat. Off. | 222/94 |
| 2540075 | 8/1984 | France | 222/94 |
| 625967 | 9/1961 | Italy | 222/94 |
| 555468 | 8/1943 | United Kingdom | 222/107 |

*Primary Examiner*—Kevin P. Shaver
*Assistant Examiner*—Boris Milef
*Attorney, Agent, or Firm*—Dennison, Meserole, Pollack & Scheiner

[57] ABSTRACT

The invention concerns a tube for the distribution of a paste with stripes in which the head 1 which is connected by moulding to the skirt 4 of the tube has an inner skirt 8 which is in one piece with said head 1, which skirt 8 having flow openings 13, 14 for the stripe product, which skirt 8 has pairs of inner longitudinal ribs 17, 18, 22 for guiding the stripe product, disposed on respective sides of said openings 13, 14 and extending towards the top of the neck portion 7. The head of the tube is of a double skirt configuration, its outer skirt 16 forming the outside of the neck portion 7 and its inner skirt 8 extending from the top 5 of the head 1 and forming the inside of the neck portion 7 and the discharge duct 8 for the pasty product. Flow openings 13, 14, 15 are disposed in part at least above the notional extension of the slightly inclined rear surface 10 of the shoulder 2. The inner skirt 8 carries inner longitudinal ribs 26, 35 for retarding the flow of the main pasty product, and the ribs comprise ribs 26 extending from each flow opening 14 to at least the lower third of the portion of the skirt 8 which is disposed below the opening 14.

19 Claims, 1 Drawing Sheet

FIG.1
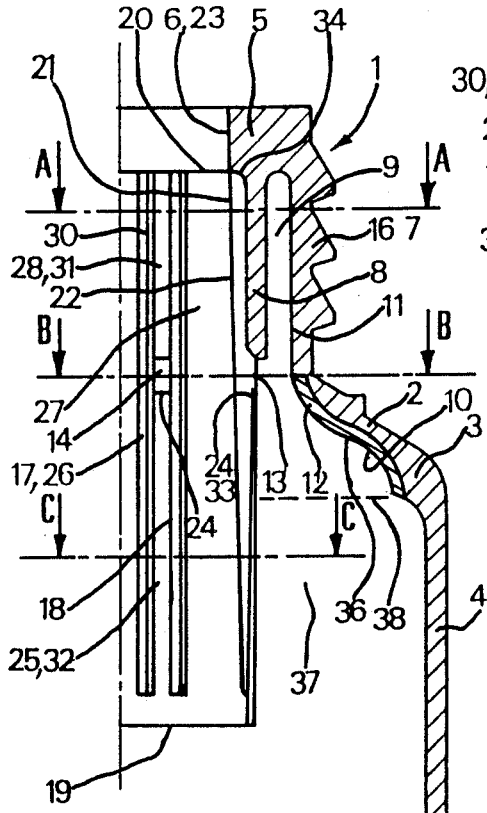
FIG.2
HALF-SECTION AA
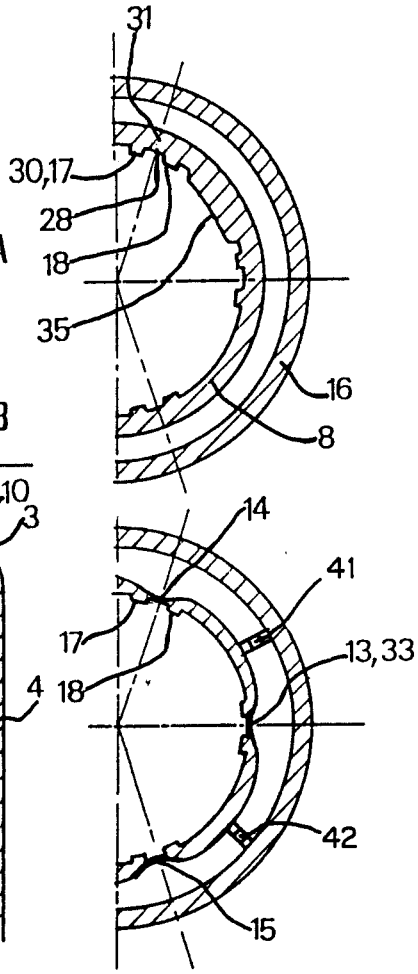
FIG.3
HALF-SECTION CC
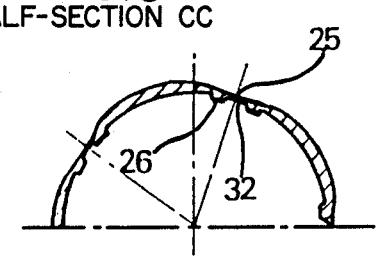
FIG.4
HALF-SECTION BB
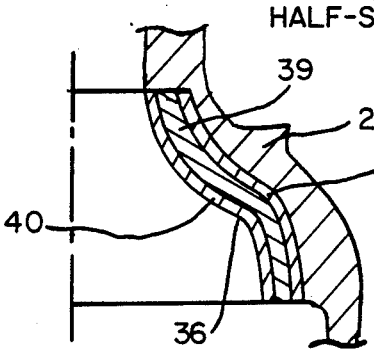
FIG.5

TUBE FOR THE DISTRIBUTION OF A PASTE WITH STRIPES COMPRISING A ONE-PIECE HEAD WITH A DOUBLE SKIRT

BACKGROUND OF THE INVENTION

1. Field of the Invention;

The invention concerns a flexible tube comprising a skirt and a head which are both at least in part of plastics material for the distribution of a paste with stripes.

2. Description of Related Art

FR-B-2 572 366 (=EP-A-0 182 725) to the present applicants describes such a tube in which the head comprises a neck portion which carries a discharges orifice and possibly a cap, and below the neck portion a shoulder by way of which the head is connected by moulding to the skirt of the tube, the head further comprising an inner skirt of plastics material which is in one piece with the head, being moulded in the same injection moulding operation as the head. The inner skirt has slots for the striped product to pass therethrough, and often pairs of longitudinal ribs which extend from the top of the slots towards the top of the internal surface of the neck portion, for guiding the coloured product for discharge thereof in the form of a stripe in the pasty material. The slots for the coloured product to pass therethrough go down to the lower end of the inner skirt when the product for the stripes is fairly viscous.

With the tubes in accordance with the foregoing description, having longitudinal ribs bordering only over a distance of 2 mm the top of the longitudinal slots which extend to the bottom of the inner skirt and extending to a position in line with the orifice of the neck portion, experience has shown that the stripes produced in the distributed pasty material have woolly contours, particularly at the end of distribution of the pasty material. In addition, when beginning the step of pressing the tube, the coloured stripes appear clearly in the strand of paste which is discharged, only with a delay that is typically 10 to 20 mm after the strand of pasty material begins.

In addition, and this is a nuisance, experience has shown that with the same tubes and also with tubes having a stripe-producing end portion fitted thereto, the inner, generally non-deformable skirt was often felt by the user as an obstacle to completing expulsion of the pasty material.

The applicants sought to develop a tube for the distribution of a paste with stripes, having an inner skirt in one piece with the head of the tube, which with a structure which is favourable to mass-production moulding, both gives an improved quality of stripe and provides that the stripes appear closer to the beginning of the strand of pasty material. As an additional consideration, the applicants also tried to make the inner skirt deformable, so as to be compatible with the foregoing requirements and also eliminating the impediment flet by users at the end of the operation of pressing material out of the tubes.

SUMMARY OF THE INVENTION

Like above mentioned FR-B-2 572 366, the invention concerns a tube for the distribution of a paste with stripes comprising a skirt and a head which are both at least in part of plastics material, the head comprising a neck portion, said neck portion carrying a discharge orifice and, below the neck portion, a shoulder comprising a slightly inclined rear surface by way of which the head is connected by moulding to the skirt of the tube, said head further comprising an inner skirt of plastics material which is in one piece with the head and carries openings for the stripe product or products to pass therethrough, said skirt and the interior of the neck portion together forming the duct for discharge of the pasty product and bearing pairs of inner longitudinal ribs for guiding said striped product or products extending/at least from the top of the neck portion, siad head whose discharge orifice is possibly surmounted by a tear-off cap forming an assembly which is moulded in a single operation on the skirt of the tube.

In accordance with the invention, the following three conditions are fulfilled at the same time:

(a) the neck portion of the tube is of a double skirt configuration, its outer skirt and its inner skirt starting from the top thereof and forming the interior of the neck portion and therefore the whole of the duct for discharge of the pasty product, its two skirts defining therebetween an annular gap into which the stripe product or products passes;

(b) said openings for the stripe product or products to pass therethrough are disposed in part at least and preferable entirely above the notional extension of the slightly inclined rear surface of the shoulder; and (c) the inner skirt bears inner longitudinal ribs which brake the main pasty product, comprising ribs going from each flow opening to at least the lower third of the portion of said skirt which is disposed beneath said opening.

In the following description and in accordance with convention, the vertical direction is that of the axis of the tube and the term "longitudinal" denotes a direction which is close to the axial direction, the top of the tube corresponding to the neck portion thereof. The "horizontal" plane is any plane perpendicular to the above-mentioned axis and the words "inclined" or "slightly inclined" relate to inclination with respect to such a horizontal plane.

By virtue of the first feature (a), there is an annular gap between the top of the inner skirt and the outer skirt or outer wall of the neck portion, and the coloured product passes into that annular gap so that, in accordance with the second features (b), the openings for the coloured product or products to flow therethrough can be taken up into that gap, above the extension of the rear surface of the shoulder, which is slightly inclined (typically at 20° to 35°).

In addition, and in such a fashion as to be compatible with a moulding operation, to provide for good definition of the stripes, it was found to be necessary, in accordance with feature (c) to provide the inner skirt with inner longitudinal ribs preceding each opening, the function of such ribs being to brake the main flow of pasty material by locally grooving it, so that the impact thereof on the flows of stripe product or products issuing from the flow openings is reduced.

In overall terms, by virtue of the combination of the three features referred to above, the first of those features resulting in a slower movement of the pasty product in the discharge duct by virtue of a reduction in the cross section thereof, upon comparative use of the tubes according to the invention and tubes in accordance with FR-B-2 572 366 of the same size (25 ml and with a skirt diameter of 22 mm) and filled with the same products, the following points were found:

a substantial reduction in the length of strand of pasty product without a stripe, with the tubes of the invention (for example 5 to 6 mm instead of 15 to 20 mm), and good definition of the coloured stripes with the same tubes.

It can be noted that, by virtue of the invention of the inner skirt, the annular space between the inner skirt on the one hand and the shoulder and the skirt of the tube on the other hand is wider than in the situation where the inner skirt extends the neck portion of the tube (FR 2 572 366). That facilitates filling the coloured product and that product, depending on its viscosity, penetrates to a greater or lesser degree into the annular gap referred to above, which prolongs the annular space.

That therefore provides a small reserve of coloured product at the location of and above the flow openings therefor, which is favourable to regularity of the flow of coloured product through those openings and also, as has been found, constancy of taste of the pasty material issuing from the tube.

In order to facilitate progression of the coloured product towards the flow openings therefor, it is highly desirable for the rear surface of the shoulder, between its slightly inclined surface and the inner surface of the outer skirt which forms the outside of the neck portion, to comprise an inclined surface forming a bevel, preferably at 50° to 70° with respect to the horizontal plane, and being substantially frustoconical. Such a bevel increases the entry diameter of the annular gap, that increase giving rise to an increase in the size of the annular cross section for the flow of coloured product towards the flow opening or openings therefor, which typically attains 80 to 120%. In addition, when the tube is pressed, the inclined bevel creates a flow of coloured product along its surface, directing the coloured product upwardly, which makes it possible to feed the product to flow openings which are disposed a little higher than when there is no bevel. The top of such openings is then preferably to be disponsed at the intersection of the notional extension of the bevel-forming inclined surface and the inner skirt or below that intersection. The provision of the circular bevel facilitates removal of the moulded component from the mould.

Preferably, in order to permit the tube to be pressed without difficulty and to provide for optimum emptying of the tube, the inner skirt comprises, from each flow opening to the lower end thereof, a longitudinal zone of reduced thickness, which permits it to be flattened. The braking ribs then typically comprise pairs of ribs which are disposed on respective sides of the flow openings and then the corresponding reduced-thickness longitudinal zones. The reduced-thickness longitudinal zones are preferably reduced in thickness or grooved on the outside face of the inner skirt, which is advantages in regard to removal of the moulded component from the mould while facilitating access of the stripe-forming product or products to each of the corresponding flow openings.

The tool assembly for injection moulding of the interior of the tube according to the invention typically comprises a central tool defining the interior of the inner skirt and a peripheral annular tool defining the exterior of the inner skirt, the two tools defining by virtue of mutual contact the flow openings and comprising between them and below each of the contact zones a longitudinal aperture, the thickness of which is markedly smaller than that of the sectorial apertures corresponding to moulding of the other zones or body portion of the inner skirt. So as to facilitate removal of the moulded component from the mould, the above-mentioned longitudinal aperture is of a thickness which increases downwardly while the sectorial apertures corresponding to moulding of the body portion of the inner skirt are of a thickness which varies in the opposite direction.

The inner skirt of the tube according to the invention is thus distinguished in that preferably the thickness of each longitudinal reduced-thickness zone increases from the corresponding flow opening to the lower end of the inner skirt while the thickness of the body portion of the inner skirt decreases from said opening to said end. Typically, in axial section, the angle between the two faces of the body portion of the inner skirt and the angle between the two faces of the longitudinal reduced-thickness zones are then both between 0°15′ and 1

Typically also the thickness of each longitudinal reduced-thickness zone of the inner skirt is between 0.15 and 0.35 mm in its upper half close to the corresponding opening and between 0.25 and 0.45 mm in its lower half. Particularly in their top part, each of the longitudinal zones forming the bottom of a groove bordered by the corresponding braking ribs, at any level perpendicular to the axis of the tube, is of a thickness which is much smaller than the thickness of the body portion of the inner skirt at the same level. In practice and preferably in regard to economy of material and volume, at a given level on the inner skirt, the thickness of said doby portion is between 2 and 4 times the thickness of the reduced-thickness zones as in the case of the upper half of said zones, and between 1.2 and 3 times the thickness of the reduced-tickness zones in the case of their lower half. Those arrangements which are compatible with industrial mass-production moulding are favourable both to flattening of the inner skirt at the end of the period of use of the tuve, and to providing stripes of high quality.

It was surprisingly also found that, whereas such longitudinal reduced-thickness zones which are not bordered by ribs gave coloured stripes of variable quality in the course of use of the arrangement, it was sufficient to provide braking ribs of a reduced height of 0.2 to 0.3 mm in order to produce stripes of high quality in the case of a main pasty product which is rather viscous. The reduced height of such braking ribs or lower ribs facilitates removal of the moulded component from the mould. In cases where the longitudinal braking ribs are distributed in pairs on respective sides of each flow opening and each subjacent longitudinal zone, which may or may not be of reduced thickness, the braking ribs are thus typically of a smaller height than the height of the guide ribs and between 0.2 and 0.7 mm, the height of the guide ribs itself being between 0.4 and 1 mm.

On that subject, it may be noted that the upper ribs or guide ribs for the stripe-forming product or products also perform a function of braking the main pasty product and that the minimal heights of each of those two types of ribs, both the upper ribs and the lower ribs, in order to produce stripes of high quality, must be increased when the main pasty product is less viscous. The braking ribs may also comprise longitudinal bosses to provide for additional braking of the main pasty product, being disposed between the pairs of braking ribs on respective sides of the flow openings or between the guide ribs. Preferably each guide rib is extended to the discharge orifice of the tube, the free edge of said rib then being in alignment with the inner surface of the orifice.

In a particularly simple and advantageous fashion in regard to production of the moulding tools and removal of the moulded component from the mould, the braking ribs and the guide rib bordering each flow opening on the same side form a continuous longitudinal rib of a height which increases in an upward directions.

It was found that, with a given size of discharge orifice, it is preferable for the top of the inner skirt, being the skirt forming the discharge duct for the pasty produt, to be connected to the inside surface of the discharge orifice by way of a convergent surface, the cross section of the orifice being typically 0.6 to 0.85 times the area of the lower opening of the inner skirt. The height of the discharge orifice being slight, typicaly from 1.5 to 3 mm, the constriction in respect thereof does not cause a substantial braking effect and a wider discharge duct than that orifice is then preferable, as has been noted, to a narrower discharge duct with a connecting surface leading to the divergent orifice. In addition, to facilitate removal of the moulded component from the mould, the inner skirt is of an inside diameter which progressively decreases slightly in an upward direction.

As has already been pointed out, the flavour of the pasty product is fairly well preserved by virtue of the provision of a reserve of product for forming the stripes in the annular gap. However the flavour may be better preserved by providing the rear of the shoulder of the tube with an annular ring of metalloplastic material or of a plastics complex material, being fixed by moulding and comprising at least outer layers of polyethylene or possibly polypropylene and an intermediate layer of aluminium or barrier plastics material.

Moreover, to distribute a paste with strips of different colours or natures, the tube of the invention comprises partitioning means which separate the gap between its inner skirt and its shoulder into sectors which each contain a flow opening. The number of such partitioning means and flow openings are typically the same, from 2 to 6.

The examples and the drawings will permit the description of the tube of the invention to be completed.

BRIEF DESCRIPTION OF THE DRAWINGS

FIG. 1 shows a view in axial section of the top of a tube according to the invention, FIGS. 2 to 4 are views in cross-section taken along lines A—A, C—C and B—B perpendicular to the axis of the head of the tube, and FIG. 5 is an enlarged axial view of a portion of the tube shown in FIG. 1.

DESCRIPTION OF THE PREFERRED EMBODIMENTS.

The head 1 of the tube in FIG. 1 comprises a shoulder 2 of which the lower end is connected by moulding at the junction 3 to the skirt 4 of the tube of an outside diameter of 22 mm. The head 1 comprises a top portion 5 which at its centre has the discharge opening 6 which is of an inside diameter of 7.5 mm and, connected to the top portion 5, an outer skirt 16 forming the screwthreaded outside of the neck portion 7 and connected to the shoulder 2 and an inner skirt 8 which is 18 mm in height, forming the interior of the neck portion 7 and on its own forming the whole of the duct 8 for discharge of the pasty product. The inside surface of the outer skirt 16 is 12 mm in diameter and the top of the inner skirt 8, which is of an outside diameter of 10 mm, is separated from the outer skirt 16 by the annular gap 9 which is 0.9 to 1 mm in width. The rear surface of the shoulder 2, between its surface 10 which is inclined at 30° and the inside surface 11 of the outer skirt 16, comprises a frustoconical chamfer 12 which is inclined at an angle of 60°, doubling the annular area for flow of the coloured product towards the flow openings leading into the discharge duct as indicated at 13 and 14.

The inner skirt 8 has five flow openins which are regularly distributed arount its circumference, three thereof being indicated at 13, 14 and 15 in FIGS. 1 to 4, each one as indicated at 14 being of a substantially rectangular contour measuring $0.8 \times 1.1$ mm in its longitudinal direction and being bordered on respective sides by two longitudinal ribs 17 and 18 which extend from a level disposed at 1 mm from the lower end 19 of the outer skirt 8 to the lower end 20 of the discharge orifice 6. The ribs 17 and 18 are of a height which regularly increases in an upward direction, said height thus varying from 0.3 to 0.5 mm in their portion 26 for producing a braking effect alone, below the openings as at 14, and 0.5 to 0.6 mm in their guide and braking portion extending from the openings such as indicated at 14, to the orifice 6. The upper or free edge 21 of each rib as indicated at 22 is disposed in alignment with the inside surface 23 of the discharge orifice 6 so as not to leave any unevenness impeding the pasty product in its flow through the arrangement. Each flow opening as indicated at 13 to 14 is entirely contained between the notional extensions of the slightly inclined surface 10 and the frustoconical chamfer or bevel 12 of the rear surface of the shoulder, the bottom of said openings being about 0.5 mm above the surface 10 and the inner skirt 8.

Beginning at the bottom as indicated at 24 of each opening as indicated at 14 is a longitudinal reduced-thickness zone 25 which is of the same width 0.6 mm as the opening on the outer side, as indicated at 14, extending downwardly to the bottom of the inner skirt 8, its thickness then regularly increasing from 0.2 mm below the opening 14 to 0.3 mm at the bottom of the skirt. The zone 25 is bordered over the major part of its length by lower braking portions as indicated at 26 of the longitudinal ribs 17 and 18. The thickness of the body portion 27 of the inner skirt 8 regularly decreases in a downward direction from a thickness of 0.8 mm to 0.6 mm. FIGS. 1 to 3 show views in axial section of the position of the longitudinal ribs and the grooves 28 and 32 that they define. The groove 28 at the top, or the guide groove (FIGS. 1 and 2), between its portions of ribs serving to guide the coloured product as indicated at 30, has a reduced-thickness bottom 31 which is 0.8 mm in thickness while the bottom groove 32 which extends the top groove 28 and which serves for braking the flow of main pasty product before it reaches the level of the openings such as indicated at 13 and 15, between its portions of braking ribs as indicated at 26, has a bottom formed by a longitudinal reduced-thickness zone 25 which varies in thickness from 0.2 to 0.3 mm (FIG. 3). The reduction in thickness of the lower edge 33 of each opening as indicated at 13 (FIGS. 1 and 4) makes it easier for the stripe-forming product to pass therethrough.

The lower skirt 8 is slightly frustoconial or convergent, its inside diameter varying from 9 mm at its lower open end to 8.4 mm in its upper part. The upper part is connected by a convergent connecting surface 34 to the inside surface 23 of the discharge orifice 6, being of an inside diameter of 7.5 mm and 2 mm in height. Those arrangements make it easier to remove the moulded component from the mould and the entry cross-sections of the inner skirt and the discharge orifice are respectively 63 $mm^2$ and 44 $mm^2$ in area, permitting an easier progression in the flow of the pasty product towards the discharge orifice 6.

In an alternative embodiment, for a less viscous coloured product, the inner skirt 8 was provided with 5 additional longitudinal braking bosses as indicated at 35 (see FIG. 2), forming flat portions of a width of 2 mm and of an increased thickness of 0.5 mm, each being disposed between the pairs of ribs as at 17 and 18 on respective sides of two adjacent openings 13 and 14. The bosses 35 extend in this case over the entire height of the longitudinal ribs such as 17.

FIG. 1 also shows the position of an annular metalloplastic disc 36 consisting of 5 layers forming a barrier in relation to flavourings, lining the rear 10 and 12 of the shoulder 2 and being connected to the shoulder 2 by the moulding operation, the surface layers 40 thereof being of polyethylene the intermediate layer 39 being of aluminum. The flexible disc 36 is fitted around the annular tool forming the annular chamber 37 and the annular gap 9, which is particularly simple.

TESTS 1. 5 tubes in accordance with the foregoing description, the head 1 being of polyethylene and the skirt 4 being metalloplastic, not any bosses 35 or metalloplastic disc 36, were compared to 3 tubes in accordance with the prior art (FR 2 572 366) of the same capacity of 25 ml and the same diameters in respect of the discharge orifice (7.5 mm) and the skirt (22 mm), with the same pasty products in the two types of tubes. Tests relating to distribution of the pasty product give coloured stripes of an outline which is not clearly marked, in the case of the prior-art tubes. In the case of the tubes according to the invention, the results obtained were as follows:

stripes began markedly earlier, at 5 to 6 mm from the beginning of the strand of pasty product discharged from the tube, instead of 15 to 20 mm as with the prior-art tubes;

clearly defined strips with clearly marked edges; and no difficulties in pressing out the tubes at the end of the period of use thereof.

2. With a main pasty product and a coloured product less viscous than in the previous case, there was an improvement in the clear outlines of the coloured stripes with tubes according to the invention provided with longitudinal bosses as indicated at 35.

3. Three tubes of the same geometry as in the first series of tests were prepared, the structure of each tube being supplemented by five radial partitions disposed between the flow openings for the pasty product, with the lower horizontal edge disposed just below the shoulder, the position 38 of that lower edge being shown in FIG. 1. Partitions 41 and 42 are shown in FIG. 4, dividing the annular gap on either side of flow opening 13.

Tests relating to the distribution of pasty product were then effected with five different coloured products which in respect of each tube were placed in each of the sectors defined by the foregoing radial partitions. The distribution tests gave stripes in the five colours, with an excellent degree of definition, on the strands of pasty product discharged from the tubes. 4. Tubes of a skirt diameter of 35 mm and of a capacity of 150 ml of product with the same head structure were produced, the shoulder 2 simply being extended outwardly for connection thereof to the skirt. The gap and the annular chamber were filled with stripe-forming product to the same level, substantially to the bottom 38 of the shoulder 2 (see FIG. 1). It was found that it was easy to expel the pasty product, with stripes which appear early and which are clearly marked. It was also found that the stripes persisted to the end of distribution of the pasty product.

The invention simultaneously provides the following:

early appearance of the coloured stripes;

stripes which are particularly well defined, with clearly marked outlines;

an one-piece design configuration which is easy to mould and which is suited to mass production; and according to the last test, a head structure which can be adapted to various capacities, with regulating conditions which are not critical;

possibly, by virtue of the reduced-thickness longitudinal zones, a tube head with an inner skirt which flattens out without causing difficulty or awkwardness at the end of use of the tube.

What is claimed is:

1. A tube for dispensing a paste with stripes comprising a body portion connected to a head portion, both portions made at least in part of plastic material, the head portion being of unitary construction and comprising a neck portion connected to a shoulder portion comprising a slightly inclined inner annular surface by which said head portion is connected to said body portion;

said head portion comprising an annular outer skirt and an annular inner skirt connected together by a top portion at the top end of said neck portion and defining an annular gap therebetween in said neck portion which gap is closed by said top portion, the interior of said inner skirt being open at the top end of said neck portion and defining a discharge duct and orifice for said tube, said inner skirt including a plurality of flow openings therein, disposed at least in part above a notional extension of said inclined inner annular surface but below said top portion to thereby define a reservoir in said annular gap between said flow openings and said top portion, and a plurality of pairs of inner longitudinal ribs, a flow opening being disposed between each said pair of ribs, said pairs of ribs extending from the vicinity of the top of said neck portion, to said flow openings to guide paste being dispensed and from said flow openings to the lower third portion of said inner skirt, to brake paste being dispensed.

2. A tube according to claim 1, wherein the inner surface of the shoulder (2) comprises an inclined surface forming a bevel (12) between said slightly inclined surface and the inner surface of said outer skirt.

3. A tube according to claim 2, wherein the inclined surface forming a bevel (12) is substantially frustoconical and is at 50° to 70° with respect to the horizontal plane.

4. A tube according to claim 1, wherein from each flow opening (14) to the bottom (19) of the inner skirt (8), said skirt comprises a reduced-thickness longitudinal zone (25), its braking ribs (26) comprising pairs of ribs (17 and 18) which are disposed on respective sides of said flow openings (14) and of said reduced-thickness zones (25).

5. A tube according to any one of claims 1, 2 or 3, wherein the top portion is connected to the inside surface (23) of the inner skirt by way of a convergent surface, the cross-sectional area of said orifice (6) being equal to 0.6 to 0.85 times the area of the lowermost portion of said inner skirt (8).

6. A tube according to claim 4, wherein the braking ribs also comprise longitudinal bosses for supplementary braking of paste dispensed therealong, the bosses being disposed between the pairs of braking ribs on respective sides of the flow openings or between the pairs of guide ribs.

7. A tube according to claim 4, wherein the braking rib and guide rib bordering each flow opening on the same side is in the form of a continuous longitudinal rib of a height which increases upwardly.

8. A tube according to claim 1, 2, 3 or 4, wherein the inner surface of the shoulder is lined with an annular disc which is fixed by a molding operation, the disc comprising at least outer layers of polyethylene and an intermediate layer of aluminum or barrier plastic material.

9. A tube according to claim 2, 3 or 4 for distribution of a paste with stripes of different colors or natures additionally comprising partitions which separate the gap between the inner skirt on one hand and the outer skirt and the shoulder of the tube on the other hand into sectors, each containing a flow opening, said partitions and flow openings being provided in the same number of between 2 and 6.

10. A tube for dispensing a paste with stripes comprising a body portion connected to a head portion, both portions made at least in part of plastic material, the head portion being of unitary construction and comprising a neck portion connected to a shoulder portion comprising a slightly inclined inner annular surface by which said head portion is connected to said body portion;

said head portion comprising an annular outer skirt and an annular inner skirt connected together by a top portion at the top end of said neck portion and defining an annular gap therebetween in said neck portion, the interior of said inner skirt being open at the top end of said neck portion and defining a discharge duct and orifice for said tube, said inner skirt including a plurality of flow openings therein, disposed at least in part above a notional extension of said inclined inner annular surface, and a plurality of pairs of inner longitudinal ribs, a flow opening being disposed between each said pair of ribs, said pairs of ribs extending from the vicinity of the top of said neck portion, to said flow openings to guide paste being dispensed and from said flow openings to the lower third portion of said inner skirt, to brake paste being dispensed, wherein the inner surface of the shoulder comprises an inclined surface forming a bevel between said slightly inclined surface and the inner surface of said outer skirt, and wherein the top of each flow opening is at the highest at the intersection of the notional extension of the inclined bevel forming surface and the inner skirt.

11. A tube according to claim 10, wherein the top portion is connected to the inner surface of the inner skirt by way of a convergent surface, the cross-sectional area of said orifice being equal to 0.6 to 0.85 times the area of the lowermost portion of the inner skirt.

12. A tube for dispensing a paste with stripes comprising a body portion connected to a head portion, both portions made at least in part of plastic material, the head portion being of unitary construction and comprising a neck portion connected to a shoulder portion comprising a slightly inclined inner annular surface by which said head portion is connected to said body portion;

said head portion comprising an annular outer skirt and an annular inner skirt connected together by a top portion at the top end of said neck portion and defining an annular gap therebetween in said neck portion, the interior of said inner skirt being open at the top end of said neck portion and defining a discharge duct and orifice for said tube, said inner skirt including a plurality of flow openings therein, disposed at least in part above a notional extension of said inclined inner annular surface, and a plurality of pairs of inner longitudinal ribs, a flow opening being disposed between each said pair of ribs, said pairs of ribs extending from the vicinity of the top of said neck portion, to said flow openings to guide paste being dispensed and from said flow openings to the lowest third portion of said inner skirt, to brake paste being dispensed, wherein from each flow opening to the bottom of the inner skirt, said skirt comprises a reduced thickness longitudinal zone, its braking ribs comprising pairs of ribs which are disposed on respective sides of said flow openings and of said reduced thickness zones, said reduced thickness zones being reduced in thickness on the outer face of the inner skirt and the thickness of each reduced thickness zone increasing from the corresponding flow opening to the lower end of the inner skirt while the thickness of the body of the inner skirt decreases from said opening to said lower end.

13. A tube according to claim 12, wherein in axial section the angle between the two faces of the body (27) of the inner skirt (8) and the angle between the two faces of the reduced-thickness longitudinal zones (25) are both between 0°-' and 1

14. A tube according to claim 13 wherein the thickness of each reduced-thickness zone (25) is between 0.15 and 0.35 mm in its upper half and between 0.25 and 0.45 mm in its lower half.

15. A tube according to claim 14 wherein at a given level of the inner skirt (8), the thickness of its body (27) is between 2 and 4 times the thickness of its reduced-thickness zones (25) in the case of the upper half of said zones and between 1.2 and 3 times the thickness of its reduced-thickness zones (25) in the case of the lower half of said zones.

16. A tube according to claim 12, 13, 14 or 15, wherein the braking rib and guide rib bordering each flow opening on the same side is in the form of a continuous longitudinal rib of a height which increases upwardly.

17. A tube according to claim 10, 12, 13, 14 or 15, wherein the inside surface of the shoulder (2) is lined with an annular disc (36) which is fixed by a moulding operation, the disc (36) comprising at least outer layers of polyethylene and an intermediate layer of aluminum or barrier plastics material.

18. A tube according to claim 10, 12, 13, 14 or 15 for distribution of a paste with stripes of different colours or natures additionally comprising partitions which separate the gap between the inner skirt (8) on the one hand and the outer skirt (16) and the shoulder (2) of the tube on the other hand into sectors each containing a flow opening (13, 14, 15), said partitions and said flow openings (13, 14, 15) being provided in the same number between 2 and 6.

19. A tube according to any one of claims 12, 13, 14 or 15 wherein the braking ribs (26, 35) also comprise longitudinal bosses (35) for supplementary braking of paste dispensed therealong, the bosses being disposed between the pairs of braking ribs (17, 26 and 18) on respective sides of the flow openings (13, 14) or between the pairs of guide ribs (17, 18).

* * * * *